US005410858A

United States Patent [19]

Osti et al.

[11] Patent Number: 5,410,858

[45] Date of Patent: May 2, 1995

[54] DEVICE FOR SEALING WRAPPERS IN MACHINES FOR WRAPPING AND/OR OVERWRAPPING COMMODITIES, IN PARTICULAR PACKETS

[75] Inventors: Roberto Osti, Zola Predosa; Antonio Gamberini, Bologna, both of Italy

[73] Assignee: G.D S.p.A., Bologna, Italy

[21] Appl. No.: 165,542

[22] Filed: Dec. 13, 1993

Related U.S. Application Data

[63] Continuation of Ser. No. 907,564, Jul. 2, 1992, abandoned.

[30] Foreign Application Priority Data

Jul. 29, 1991 [IT] Italy ..... B091A0282

[51] Int. Cl.[6] ..... B65B 51/10

[52] U.S. Cl. ..... 53/477; 53/371.5; 53/387.3

[58] Field of Search ..... 53/234, 284, 371.3, 53/371.5, 371.6, 372.4, 375.9, 376.2, 387.2, 387.3, 377.8, 477

[56] References Cited

U.S. PATENT DOCUMENTS

| | | | |
|---|---|---|---|
| 609,472 | 8/1898 | Smyser | 53/372.4 |
| 1,608,163 | 11/1926 | Bronander | 53/372.4 X |
| 1,974,931 | 9/1934 | Rose | 53/387.2 X |
| 2,727,345 | 12/1955 | Schoppee | 53/371.3 |
| 2,855,977 | 10/1958 | Wagner | 53/371.5 |
| 3,075,326 | 1/1963 | Waite | 53/477 X |
| 3,105,334 | 10/1963 | Marshall | 53/387.2 X |
| 3,282,760 | 11/1966 | Gutierrez | 53/477 X |
| 3,372,526 | 3/1968 | Anderson | 53/372.4 X |
| 3,979,881 | 9/1976 | Seragnoli . | |
| 4,098,057 | 7/1978 | Holcomb | 53/371.3 X |
| 4,196,560 | 4/1980 | Seragnoli | 53/387.3 X |
| 5,048,260 | 9/1991 | Raymond et al. | 53/371.3 |
| 5,179,814 | 1/1993 | Osti et al. | 53/375.9 X |

FOREIGN PATENT DOCUMENTS

| | | | |
|---|---|---|---|
| 114112 | 12/1941 | Australia | 53/371.5 |
| 0395809 | 11/1990 | European Pat. Off. . | |
| 1018092 | 9/1977 | Italy . | |
| 1544644 | 4/1979 | United Kingdom . | |

*Primary Examiner*—Linda B. Johnson
*Attorney, Agent, or Firm*—Cushman Darby & Cushman

[57] ABSTRACT

A device for sealing wrappers around products comprising an infeed mechanism for conveying products enveloped by sealable wrappers and a first drive mechanism for driving the infeed mechanism to convey the products with a first predetermined velocity. A sealing channel into which the products are directed by the infeed mechanism includes a feed mechanism for moving the products along the sealing channel and a sealing mechanism for compressively sealing at least one face of the sealable wrappers. A second drive mechanism drives the feed mechanism to move the products along the sealing channel with a second predetermined velocity corresponding to at least one physical characteristic of the sealable wrappers, the second drive mechanism being independent from the first drive mechanism so that the second predetermined velocity and the first predetermined velocity can be independently determined.

23 Claims, 3 Drawing Sheets

DEVICE FOR SEALING WRAPPERS IN MACHINES FOR WRAPPING AND/OR OVERWRAPPING COMMODITIES, IN PARTICULAR PACKETS

This is a continuation of application Ser. No. 07/907,564, filed on Jul. 2, 1992, which was abandoned upon the filing hereof.

BACKGROUND OF THE INVENTION

The present invention relates to a device for sealing wrappers in machines for wrapping and/or overwrapping products, in particular packets of cigarettes.

It is a fundamental requirement when heat-sealing thermoplastic materials, or other materials bonded with an interfacing layer of hot melt adhesive, that the elements which perform the sealing action be held in contact with the parts to be sealed for a period of time that remains constant in duration and depends solely upon the nature of the sealed materials.

This unvarying duration of contact must be maintained irrespective of the rate at which products are directed toward and through the sealing station. By the same token, to maintain high levels of productivity, the products must be conveyed at a speed not unduly slowed down by the sealing operation.

The prior art embraces devices equipped with a pair of heated plates positioned on opposite sides of a conveyor belt along which the single products are carried, each enveloped in a respective wrapper. The plates are reciprocated through an operating stroke, which brings them into contact with the end faces of the wrappers, and a corresponding return stroke.

It is absolutely essential with such devices that the duration of contact between the plates and the respective faces of the wrappers not be varied, since the thermoplastic material from which the wrappers are fashioned must be heated up to but not beyond a given temperature, whatever the operating speed of the machine.

The general practice is to connect the two plates to a non-adjustable source of energy, for example to one or more electrical resistors, and then to determine the exact duration of the contact between plates and wrapper employing a variety of means. Given that no wrapping machine will ever operate at one constant speed, it follows that the duration of contact between the heated plates and the wrapper needs to be matched to the different speeds of the machine.

In the device of Italian Patent No. 1,018,092, for example, the duration of contact between the heated plates and the end folds of a wrapper is determined by means of a single cam type element which affords two or more profiles engaged by a following roller associated mechanically with the plates.

Whilst the sealing device embodied in this way has proved capable of effective and precise operation over time, it nonetheless has a marked lack of flexibility inasmuch as a change in the operating speed of the machine dictates the replacement of the cam. This presents obvious drawbacks.

The object of the present invention is to provide a device from which the drawbacks mentioned above are eliminated in a simple and functional manner.

SUMMARY OF THE INVENTION

The stated object is realized in a device according to the invention for sealing wrappers in machines for wrapping and/or overwrapping products, in particular packets of cigarettes. Such a device includes infeed means with products enveloped in respective wrappers to be sealed, and comprises a sealing channel into which the commodities are directed at one end by the infeed means, feed means by which the products are directed along the channel, and drive means by which the feed means are set in motion in such a manner as to determine the duration of the passage of each product along the sealing channel according to given physical properties of the wrappers and independently of the operating tempo of the infeed means.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
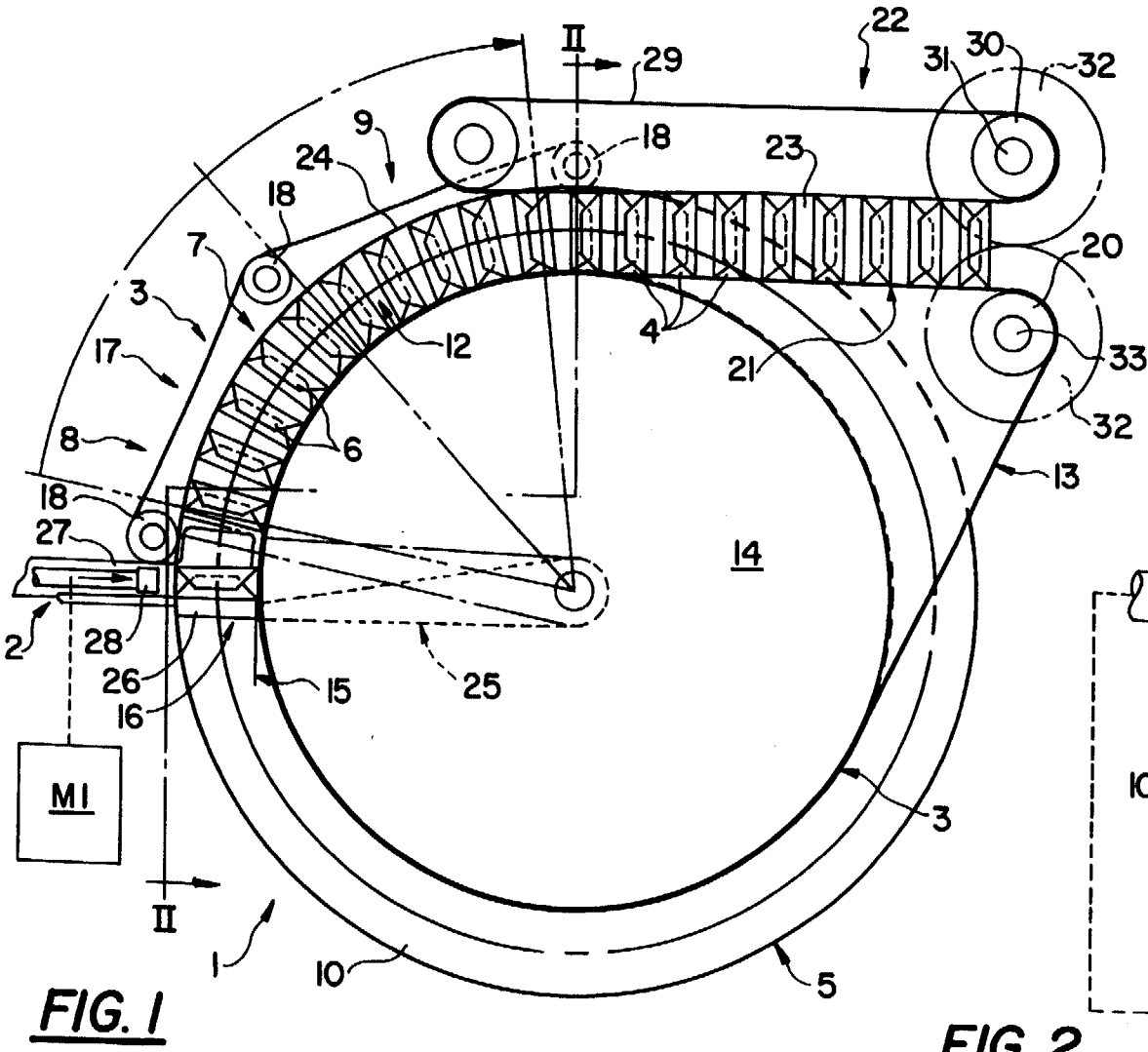
FIG. 1 shows the device according to the invention in a schematic side elevation.
Figure 3:
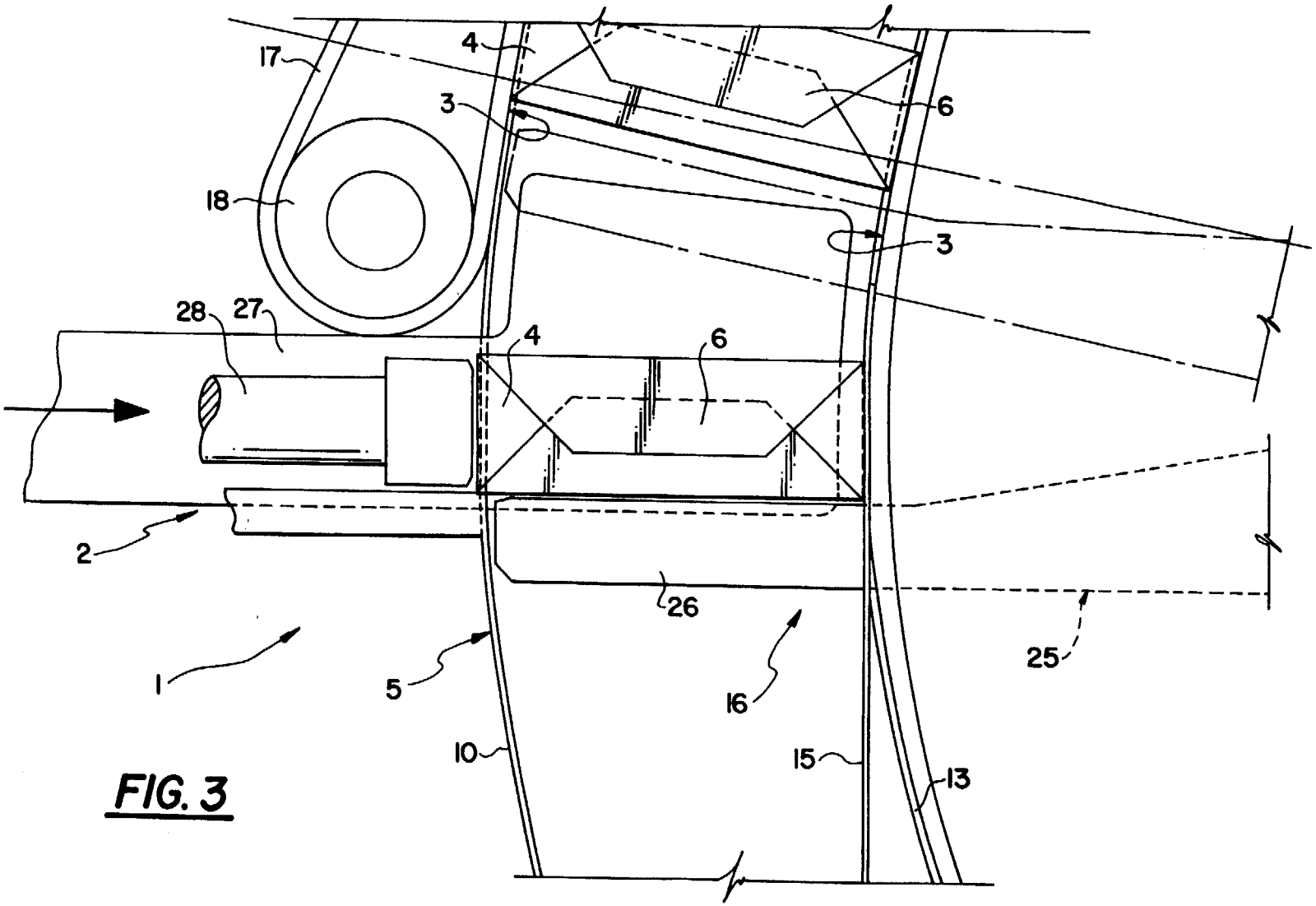
FIG. 3 shows a detail of FIG. 1, enlarged and in side elevation.

With reference to FIG. 1, 1 denotes a device according to the present invention, in its entirety, by which wrappers are sealed in a machine for wrapping and/or overwrapping products 4, in particular packets of cigarettes. Such a device 1 comprises relative infeed means 2 by which the products 4 are transferred in succession from a machine in which products 4 were each enveloped in a respective wrapper ready to be sealed.

The device 1 comprises a sealing channel 12 located following the infeed means 2, in relation to the flow of products 4, and feed means 24 by which the commodities 4 are directed along the channel. The feed means 24 are set in motion by respective drive means M independently of the infeed means 2 and in such a manner that the products 4 will occupy the channel 12 for a duration of which the value is maintained constant, and dictated exclusively by the physical properties of the wrappers: "physical properties" signifying such characteristics as will contribute to the realization of a faultless seal, i.e. those of the material from which the wrappers are fashioned, including the thickness, in the case of a heat-sealable material, and the physical and chemical attributes of the adhesives in the event that the wrapping is fashioned from other types of material such as paper.

Figure 2:
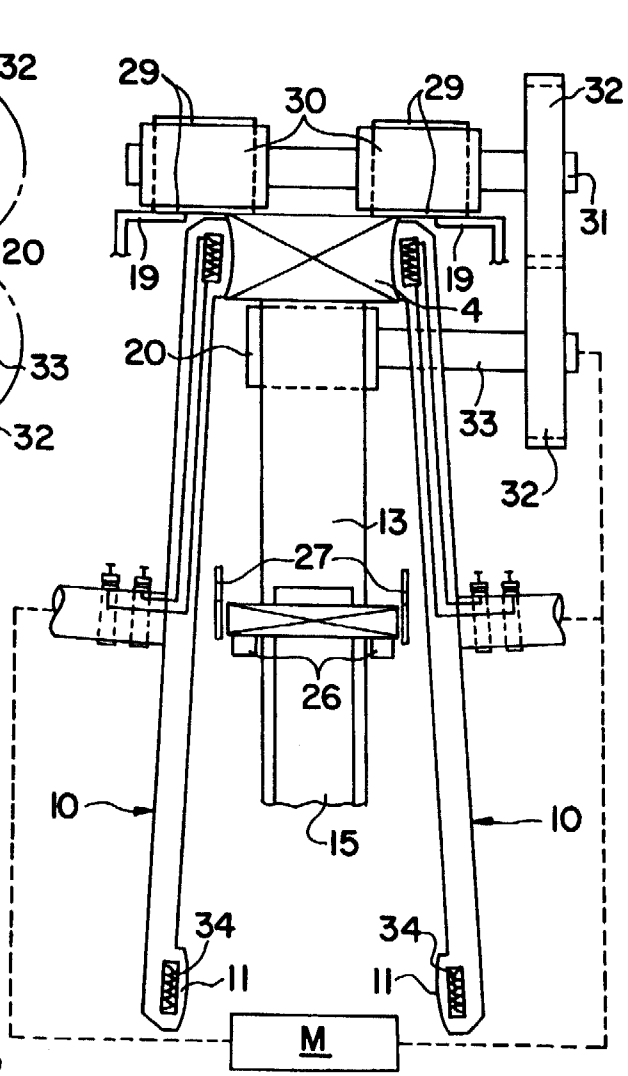
FIG. 2 is a section through II—II in FIG. 1, shown with certain parts cut away and certain parts omitted better to reveal others.

As discernible from FIGS. 1 and 2 in particular, the channel 12 is compassed by guide means 3, and means denoted 5 by which the products 4 are compressed bilaterally and sealed.

With regard to the various elements which make up the device 1, the guide means 3 occupy and operate within at least a limited area of the device 1, and are positioned in such a way as to remain entirely clear of the faces 6 of the products 4 destined to be sealed.

The feed means 24 occupy and operate in at least the same area as is occupied by the guide means 3. Finally, the bilateral compression and sealing means 5 are designed to impinge during the sealing step, and within the compass of the guide means 3, on at least one of the faces 6 of the products 4 to be sealed.

The bilateral compression and sealing means 5 are structured and positioned in such a manner as to engage in contact with the products 4 advanced by the guide means 3, at least through a trajectory of predetermined length denoted 7.

As shown in the drawings, the bilateral compression and sealing means 5 consist in a pair of rotatable heated disks 10. In the example illustrated, more exactly, the rotating and heated disks 10 are one and the same as the feed means 24, and constitute the side walls of the sealing channel 12.

The axes of rotation of the disks 10 are angled in relation to the axis of the sealing channel 12 in such a way that the minimum clearance between the disks occurs substantially midway along the length of the channel.

In practice, the effect of inclining the axes of rotation of the heated disks 10 is to divide the trajectory 7 established by the sealing channel 12 into a first stretch 8 and a second stretch 9, the latter succeeding the former in relation to the motion of the feed means 24. The illustration of the trajectory 7 and its two component stretches 8 and 9 is limited to an indication of the relative angular distances, in the interests of simplicity. The first and second stretches 8 and 9 differ one from another in that the compressive force applied to the products 4 by the bilateral compression and sealing means 5 increases gradually through the first stretch 8 and decreases gradually through the second stretch 9. Compressive force transmitted to a products 4 by the rotating and heated disks 10 is therefore maximum when the clearance between the two disks is minimum. As discernible clearly enough from FIGS. 1 and 4, the trajectory 7 depicts an arc of a circle of which the center coincides with the intersection of the axes of the rotating and heated disks 10.

To reiterate, the principal feature of the device 1 according to the invention is that the rotating and heated disks 10 are driven about their respective axes at an angular velocity which remains constant and entirely independent of the operating speed of the wrapping machine.

The heated portion of each disk 10 consists in a raised circumferential profile 11 disposed coaxial with the disk and directed toward a similar raised profile 11 afforded by the remaining disk 10 (see FIG. 2, in which 34 denotes electrical resistors embedded in the relative profiles 11).

As discernible from FIG. 2, the raised profiles 11 appear substantially rounded in section in such a manner that the maximum compressive force of the disks can be applied to the products 4 exactly in the central part of the faces 6 to be sealed. Such a feature is important when the products 4 are packets of cigarettes and the faces 6 to be sealed are the top and bottom ends of the packet, in which case the central parts of the two faces 6 coincide with the overlapping end folds of the wrapper and require greater pressure and heat.

In the embodiments illustrated, the guide means 3 can be one and the same as the feed means 24, or alternatively, both the guide means and bilateral compression and sealing means 5 may coincide with the feed means 24. In all instances, the guide means 3 encompasses the sealing channel 12 on opposite sides, extending through the circular arc enscribed by the trajectory 7, and comprise at least one element capable of movement synchronously with the rotating and heated disks 10. The guide means 3 encompassing the channel 12 on the inside includes at least one conveyor belt 13 looped around a corresponding pulley 14 and set in rotation synchronously with the heated disks 10 about an axis passing through the intersection of the angled axes of rotation of the disks.

The infeed means 2 by which the products 4 are transferred from the wrapping machine can be of any given type, for example comprising a push rod 28 capable of rectilinear movement for advancing the products 4 toward the device 1 in a radial direction in relation to the pulley 14 as illustrated in the drawings. In this instance the device 1 comprises a plate 15, disposed facing and transverse to the direction of movement of the push rod 28 and tangential to the pulley 14. Push rod 28 and transfer means 16 transfer products 4 from the infeed means 2 to the device 1. Such transfer means 16 will be capable of movement, timed opportunely with that of the infeed means 2, at least through a path of an arc to a circle of which the center coincides with the intersection of the axes of rotation of the two rotating and heated disks 10, as shown in FIG. 1. More exactly, the transfer means 16 is capable of movement at least between a first limit position of reception, in which products 4 are disposed in alignment with the infeed means 2 and in contact with the plate 15, and a second limit position of release in which the products 4 occupy the first stretch 8 of the sealing trajectory 7.

In FIGS. 1 and 2, it will be seen that the rotating and heated disks 10 are set in motion by the aforementioned drive means M, while the infeed means 2 are driven by means M1 which is independent of drive means M as already intimated. In the example of the drawings, transfer means 16 includes a fork element 25 located internally of the pulley 14 and capable of rocking between the two limit positions, described above, about an axis passing through the intersection of the angled axes of rotation of the disks 10. The prongs 26 of the fork element 25 are positioned on opposite sides of the conveyor belt 13 and the pulley 14, and free to oscillate between the pulley 14 and a relative pair of restraining plates 27. The plates 27 terminate all but in contact with the raised profiles 11 of the disks 10 and are able, in the event that the products 4 are packets of cigarettes, to keep the end folds of the wrapper pressed firmly against the packet and thus prevent them working adrift. The guide means 3 encompassing the sealing channel 12 externally will be seen to have at least one conveyor belt 17 looped around relative pulleys 18, which is driven synchronously with the rotating and heated disks 10 and rides slidably over respective contour guides 19, in such a way that the branch of the belt 17 effectively delimiting the channel 12 describes an arc to a circle of which the center coincides with the intersection of the angled axes of rotation of the heated disks 10.

The first mentioned belt 13 of the guide means 3 is looped also around a second pulley 20 positioned in such a way as to combine with the first pulley 14 in drawing a part of the belt 13 into a rectilinear branch denoted 21; this same branch 21 combines in turn with additional opposing conveyor means 22 to create a runout channel 23 continuing from and tangential to the sealing channel 12.

In FIG. 2, it will be seen that the conveyor means 22 includes a pair of belts 29 occupying a common plane and lying parallel to the rectilinear branch 21 afforded by the inner conveyor belt 13 of the guide means 3. The two belts 29 are positioned on either side of the external belt 17 in such a way that there is no break in continuity between the sealing channel 12 and the runout channel 23. To ensure that the belts 13 and 29 which combine to create the runout channel will operate at uniform velocity, the paired belts 29 are looped around respective pulleys 30 keyed to a shaft 31 connected mechanically by way of a pair of meshing gears 32 (transmission ratio i=1), to a further shaft 33 onto which the aforementioned second pulley 20 is keyed.

Figure 4:
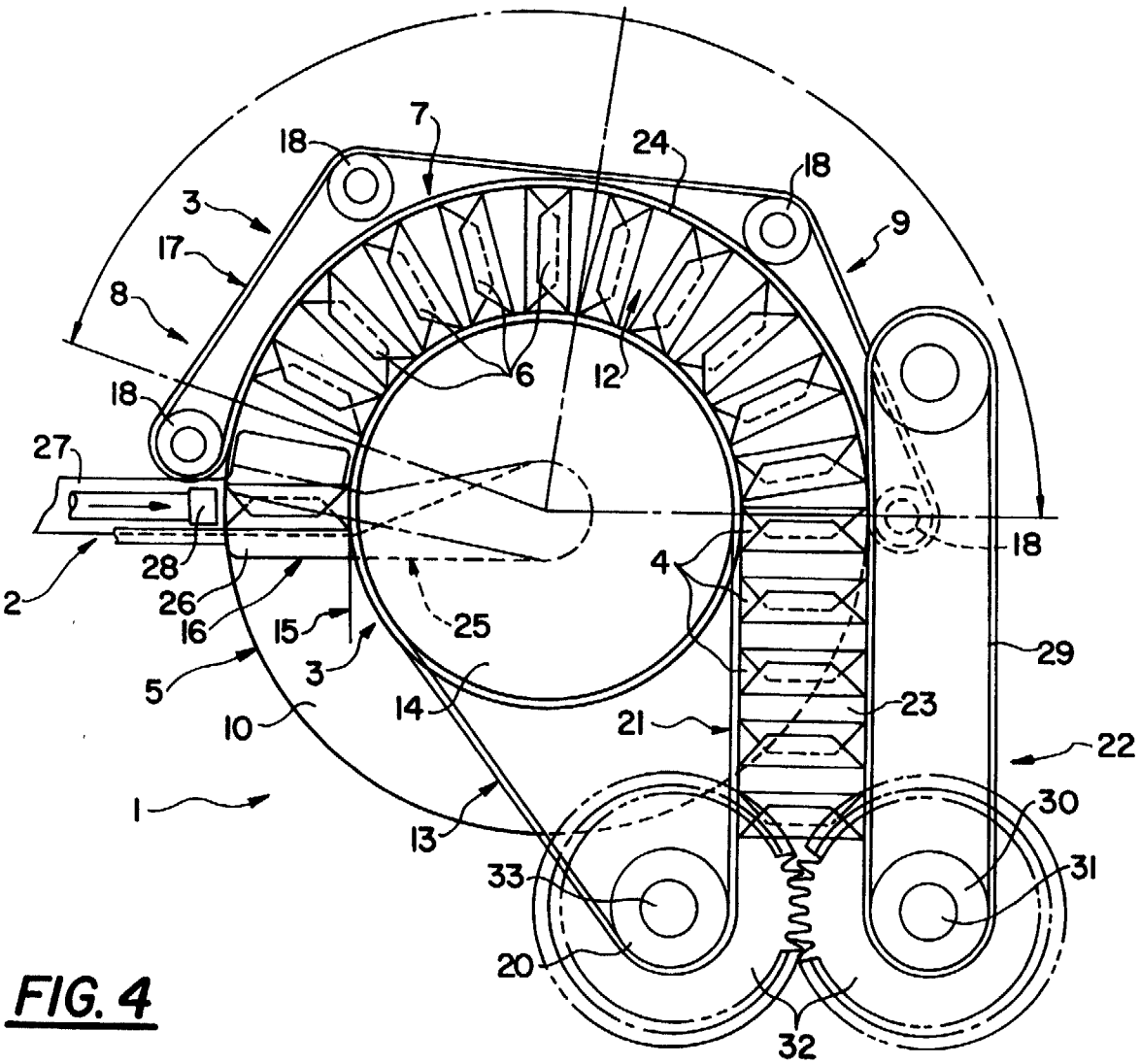
FIG. 4 is an alternative embodiment of the device illustrated in FIGS. 1-3, shown in side elevation.

The embodiment shown in FIG. 4 differs essentially from that of FIG. 1 only insofar as the sealing channel 12 is dissimilar in length. More exactly, the increased length of the channel 12 permits increasing the velocity at which the products 4 are fed through the device 1 while maintaining the duration of the sealing step at a constant value. The main advantage of the present invention is that of the independence in operation of the device 1 and the wrapping machine with which it is associated, and that the timing of the steps involved in the sealing operation can be maintained constant irrespective of the production tempo of the wrapping machine. The speed of rotation of the disks 10 is selected to suit the determining physical properties of the wrapping material used in manufacture.

While no less advantageous economically and functionally, the maintenance of the device is greatly improved since there are no components required to interact synchronously between the device 1 and the machine other than the fork element 25.

In short, the device according to the invention affords extreme flexibility.

What is claimed is:

1. A device for heat-sealing wrappers around products comprising:

infeed means for conveying products enveloped by heat-sealable wrappers;

a heat-sealing channel into which the products are directed by said infeed means, said heat-sealing channel including feed means for moving the products along said heat-sealing channel and sealing means for heat-sealing at least one face of the heat-sealable wrappers enveloping said products as they are moved along said heat-sealing channel, said sealing means effectuating said heat-sealing of said heat-sealable wrappers by being maintained in compressive heat-sealing relation with said heat-sealable wrappers for a predetermined period of time dependent upon at least one physical characteristic of said heat-sealable wrappers;

first drive means for driving said infeed means to convey said products with a first predetermined velocity so that a predetermined number of products are received by said heat-sealing channel within a specified period of time; and second drive means for driving said feed means to move said products along said heat-sealing channel with a second predetermined velocity so that said sealing means maintains said compressive heat-sealing relation for said predetermined period of time dependent upon said at least one physical characteristic of said heat-sealable wrappers, said second and first drive means being controllable independently from one another to independently set said second predetermined velocity and said first predetermined velocity according to said at least one predetermined physical characteristic and to the predetermined number of products to be received by said heat-sealing channel within said specified period of time respectively.

2. A device for heat-sealing wrappers around products as in claim 1, wherein the heat-sealing channel runs, at least in part, along a path defining an arc of a circle with a central axis, said sealing means including a pair of disks rotatable about axes angled with respect to said central axis and arranged such that the minimum distance between said disks lies substantially midway along said arc.

3. A device for heat-sealing wrappers around products as in claim 1, wherein the feed means is continuously driven by said second drive means.

4. A device for heat-sealing wrappers around products as in claim 2, wherein said sealing means further comprises heat generating means for facilitating said compressive heat-sealing of at least one face of the wrappers.

5. A device for heat-sealing wrappers around products as in claim 4, wherein said heat generating means comprises an annular raised portion at the outer periphery of each of said disks.

6. A device for heat-sealing wrappers around products as in claim 2, wherein at least one first conveyor belt is looped around at least one respective pulley rotatively driven about an axis passing through an intersection of the axes of rotation of said disks.

7. A device for heat-sealing wrappers around products as in claim 6, wherein said pulley is rotatively driven in synchronous relation with respect to said disks.

8. A device for heat-sealing wrappers around products as in claim 7, wherein said infeed means conveys said products in a radial direction with respect to said pulley.

9. A device for heat-sealing wrappers around products as in claim 8, further comprising:

a plate disposed transversely to said infeed means and tangential to said pulley; and means for transferring the products in synchronous relation with the operation of the infeed means along the path defined by said arc from at least a first limit position of reception in which the products are aligned with said infeed means and in contact with the plate and a second limit position of release in which the products enter said sealing means.

10. A device for heat-sealing wrappers around products as in claim 6, wherein the heat-sealing channel is surrounded by guide means and said feed means.

11. A device for heat-sealing wrappers around products as in claim 10, wherein at least one second conveyor belt is looped around respective pulleys, said conveyor belt being synchronously driven with respect to said disks and slidably riding over respective contour guides so that a branch of said second conveyor belt enscribes an arc to a circle that has a central axis coinciding with the intersection of the axes of rotation of the disks.

12. A device for heat-sealing wrappers around products as in claim 6, wherein the first conveyor belt is looped around a second pulley having a position relative to said first pulley so as to cause the first conveyor belt to form a tangential runout channel with an additional conveyor belt.

13. A device for heat-sealing wrappers around products comprising:

an infeed conveyor for conveying products enveloped by heat-sealable wrappers, said heat-sealable wrappers being sealable by exposure to compressive heat for a predetermined amount of time corresponding to at least one physical characteristic of said wrappers;

a first drive assembly for driving said infeed conveyor to convey said products with a first predetermined velocity;

a heat sealing channel into which the products are directed by said infeed conveyor, said heat-sealing channel including a feed conveyor for moving the products along said heat-sealing channel and a sealing device for heat-sealing the heat-sealable wrappers; and a second drive assembly for driving said feed conveyor to move said products along said heat-sealing channel with a second predetermined velocity so that said heat-sealable wrappers remain within said heat-sealing channel for said predetermined amount of time corresponding to said at least one physical characteristic of said wrappers, said second drive assembly and said first drive assembly comprising means for independently controlling the speed of said second drive assembly and said first drive assembly so that said second predetermined velocity and said first predetermined velocity can be independently set according to said at least one predetermined physical characteristic and to the predetermined number of products to be received by said heat-sealing channel within said specified period of time respectively.

14. A device for heat-sealing wrappers around products as in claim 13, wherein the heat-sealing channel runs, at least in part, along a path defining an arc of a circle with a central axis, said sealing device including a pair of disks rotatable about axes angled with respect to said central axis and arranged such that the minimum distance between said disks lies substantially midway along said arc.

15. A device for heat-sealing wrappers around products as in claim 13, wherein the feed conveyor is continuously driven by said second drive assembly.

16. A device for heat-sealing wrappers around products as in claim 14, wherein said sealing device further comprises heat generating means for facilitating said heat-sealing of the heat-sealable wrappers, said heat generating means comprising an annular raised portion at the outer periphery of each of said disks.

17. A device for heat-sealing wrappers around products as in claim 14, wherein at least one first conveyor belt is looped around at least one respective pulley rotatively driven about an axis passing through the intersection of the axes of rotation of said disks.

18. A device for heat-sealing wrappers around products as in claim 17, wherein said pulley is rotatively driven in synchronous relation with respect to said disks.

19. A device for heat-sealing wrappers around products as in claim 13, wherein said infeed conveyor conveys said products in a radial direction with respect to said pulley.

20. A device for heat-sealing wrappers around products as in claim 17, further comprising:

means for advancing the products, in synchronous relation with the operation of the infeed conveyor, along the path defined by said arc from at least a first limit position in which the feed conveyor receives the products from the infeed conveyor and a second limit position of release in which the products enter said sealing device.

21. A method for heat-sealing wrappers around products comprising the steps of:

moving products enveloped by heat-sealable wrappers along an infeed device at a first predetermined velocity toward a heat-sealing channel so that a predetermined number of products are received by said heat-sealing channel within a specified period of time;

moving said products along said heat-sealing channel at a second predetermined velocity, said heat-sealing channel including a heat-sealing device for heat-sealing said heat-sealable wrappers;

maintaining said heat-sealing device in compressive heat-sealing relation with said heat-sealable wrappers for a predetermined period of time as a function of said second predetermined velocity at which said products are moved along said heat-sealing channel so as to seal said heat-sealable wrappers; and setting said first and second predetermined velocities independently of one another and according to the predetermined number of products to be received by said heat-sealing channel within said specified period of time and at least one physical characteristic of said heat sealable wrappers respectively.

22. A method as claimed in claim 21, further comprising the step of pre-heating said heat-sealing device before said heat-sealable wrappers are maintained in said heat-sealing relation therewith.

23. A method as claimed in claim 21, wherein said heat-sealing device comprises a pair of heated disks, and further comprising the step of rotating said heated disks at a predetermined velocity to maintain said disks in said compressive heat-sealing relation with said heat-sealable wrappers for said predetermined period of time.

* * * * *